US005525095A

United States Patent [19]

Baughman

[11] Patent Number: 5,525,095

[45] Date of Patent: Jun. 11, 1996

[54] BENCH GRINDER

[75] Inventor: Karl T. Baughman, Lake Forest, Ill.

[73] Assignee: Hand Tools International, Inc., Dallas, Tex.

[21] Appl. No.: 257,524

[22] Filed: Jun. 9, 1994

[51] Int. Cl.[6] ..... B24B 9/00; B24B 53/14

[52] U.S. Cl. ..... 451/72; 451/361; 451/454; 125/11.03

[58] Field of Search ..... 451/360, 361, 451/341, 443, 444, 557, 72, 454; 125/11.03, 37, 36

[56] References Cited

U.S. PATENT DOCUMENTS

| | | | |
|---|---|---|---|
| 670,112 | 3/1901 | Rupert | 125/37 |
| 1,432,402 | 10/1922 | McLeran | 451/361 |
| 2,052,031 | 8/1936 | Merrigan | 451/361 |
| 2,069,395 | 2/1937 | Tautz | 451/456 |
| 2,109,308 | 2/1938 | Adams | 125/11.03 |
| 2,167,310 | 7/1939 | Orgitano | 451/361 |
| 2,591,434 | 4/1952 | Hrankowski | 125/11.03 |
| 3,221,727 | 12/1965 | Pitel et al. | 125/11.01 |
| 4,794,740 | 1/1989 | Keith et al. | 451/456 |
| 4,799,336 | 1/1989 | Yang | 451/456 |

*Primary Examiner* Robert A. Rose
*Attorney, Agent, or Firm* Michael G. Berkman

[57] ABSTRACT

There is described a bench grinder in which the operation of particular functional elements has been enhanced. Among significant improvements are shield-mounted lamps by means of which lighting in the work zones of the grinder is improved. Glare has been markedly reduced through directive light-shielding shades strategically located, through end lighting of the shields, and through light frequency selection. The lighting bulbs are energized by a 12-volt supply derived from pick-up leads connected to the windings of the 110-volt motor which drives the grinder wheels. The tool rest has been extended forwardly at the outer sides of the abrasive wheels to provide support laterally of the grinding wheels in addition to in-line support. A grinder-carried wheel dressing tool of a uniquely efficacious configuration facilitating its use is conveniently affixed on the grinder chassis, as is a wrench used in making selectable operational adjustments on the grinder to ensure optimum and safe operation.

11 Claims, 3 Drawing Sheets

BENCH GRINDER

FIELD OF THE INVENTION AND BACKGROUND

The present invention relates to a bench grinder. More particularly, the invention is directed to improvements enhancing the illuminiation system of a grinder of the type having a centrally positioned motor supporting a pair of laterally-projecting, driven grinding wheels or tool elements each having its own tool-support or tool rest or workpiece support shelf, and each with its operator-protecting shield.

Bench grinders of the general type in which the present inventions find utility are well-known in the art. They have assumed various physical forms many of which have features which are common in substantial respects. Protective shields overlying that portion of the abrasive wheels presented toward the operator are widely employed, as are fixed or adjustable tool or workpiece supports. Additionally, many of such bench grinders are provided with some form of an illuminating lamp, usually centrally positioned for lighting the assembly, generally.

For the most part illumination in the specific working zones of the grinders has been poorly directed and has proven less than satisfactory. Objectional glare is commonly experienced. The tool support shelves or rests have lacked versatility in their positioning and in adjustment. Absence of an at-hand or readily accessible tool for dressing the surface of the abrasive wheels has had the effect of contributing to unintended neglect in the proper maintenance of the grinder. The quality of operation of the grinders has, accordingly, been impaired. Unavailability of tools needed for adjusting the grinder, as may be advisable from time-to-time, has also been responsible for less than requisite maintenance to ensure optimum operation, and safety.

It is, therefore, a principal aim of the present invention to provide significant improvements in bench grinders. improve their safety and versatility, and to provide superior, glare-free, directed illumination in the zones of manipulated operation.

SUMMARY OF THE INVENTION

The present invention is directed to various improvements in bench grinders. Illuminating lamps mounted directly on the transparent user-protecting shields which overlie the driven abrasive wheels or tool elements provide improved, well-directed lighting facilitating one's operation of the machine and offering increased safety.

A related feature of the invention is that the lighting lamps carry shields to prevent the light from shining directly into the operator's eyes.

In a preferred embodiment of the invention the lights are in a plane with and nestingly occupy a cut-out zone of the protective shields, effectively to end-light the plastic shields at lateral edges thereof to provide dispersed, non-glare illumination in the work zone.

An important feature of the lamp elements themselves is that they are extremely shock-resistant ensuring long life, even in the demanding role they fulfill.

An auxiliary feature of the improved lighting system of the device of the invention is that the shield elements are of a yellow plastics composition further to minimize glare.

Another improvement in the grinder of the invention is that the support plate or tool or workpiece rest in front of each abrasive wheel extends forwardly at lateral zones of the wheels to provide functional mechanical support when the operator chooses to use the sidewall or side face of the wheel in a machining, polishing or grinding operation.

Another feature of the improved grinder assembly of the invention is the provision of a grinder-mounted dressing tool for cleaning, truing and refurbishing the surface of the abrasive wheels of the grinder. The improvement makes the "dresser" readily available, and at hand, to reduce a tendency to neglect this important maintenance operation.

A related feature of the invention is an improved, unique physical contour of the hand-gripped dressing tool body itself in which the dressing discs of the dresser tool are securely retained as the tool is manually presented to abut the rotating abrasive wheels.

It is a feature of the invention that the bench grinder includes a mount on which the dressing tool is conveniently secured during periods of non-use.

Yet another feature contributing to the ready and convenient maintenance and adjustment of the bench grinder components is the provision of a mount or receptacle for holding a wrench used, as required, for effecting important adjustments in the positioning of components of the bench grinder, to enhance safety.

In a preferred embodiment of the invention stops are provided to prevent pivoting of the tool rest of the grinder forwardly and downwardly beyond a horizontal disposition of said tool rest, further to ensure safety in operation.

A related feature of the invention is that the tool rest may be pivoted and may also be shifted forwardly and rearwardly with reference to the motor-driven tool elements.

Yet another feature of the bench grinder of the invention is that the wheel dressing tool includes a hand grip in a protected, interior zone thereof, and a shaft rotatably supporting the rotatable dressing discs secured in the tool, the discs having sector segments projecting radially from a housing of the hand-held tool for presentation to engage and abrade outer bounding surfaces of the abrasive wheels presented thereagainst.

It is an important feature of the invention that the illuminating bulbs are shock-resistant and physically stable, ensuring reliability and long useful life.

In a preferred embodiment of the invention the illuminating bulbs are energized by 12-volts, the power supply being derived from pick-up leads connected to the windings of the same motor (110 V.) which drives the abrasive wheels of the grinder.

Other and further objects, features and advantages of the invention will be evident from the following description considered in conjunction with the drawings.

DETAILED DESCRIPTION OF THE ILLUSTRATED EMBODIMENT

The aims and objects of the invention are realized by providing a series of improvements in bench grinders of the type including an electrically driven wheel (or wheels) rotated about a horizontal axis. Included among the areas in which improvements have been effected is the mode of lighting. Illumination has been markedly enhanced and glare has been virtually eliminated. In the dual-wheel system of the invention, a separate lamp is affixed to and manipulable with each transparent protective shield, and the shield itself is operative to control distribution of the light and to prevent objectionable reflections and glare.

A pivotal and adjustably positionable tool or workpiece rest includes areas extending forwardly along and laterally of the grinder wheels to provide support when a tool is presented to a side surface of the rotating wheel in a grinding or polishing operation.

It is an important feature of the invention that the illuminating bulbs are 12-volt bulbs which are highly resistant to physical shock and vibration. These bulbs are energized by leads connected to the windings of the 110-V motor which drives the grind wheels of the grinder assembly.

Conveniently mounted on the bench grinder itself, for ready access, is a dressing tool for refacing and truing the surface of the grinder wheel. The resurfacing tool of the grinder is of a unique construction, facilitating safe and secure hand gripping in use. Also mounted on the grinder is a wrench for use in maintaining proper adjustment of the various parts of the grinder to ensure safe and optimum operation.

Figure 1:
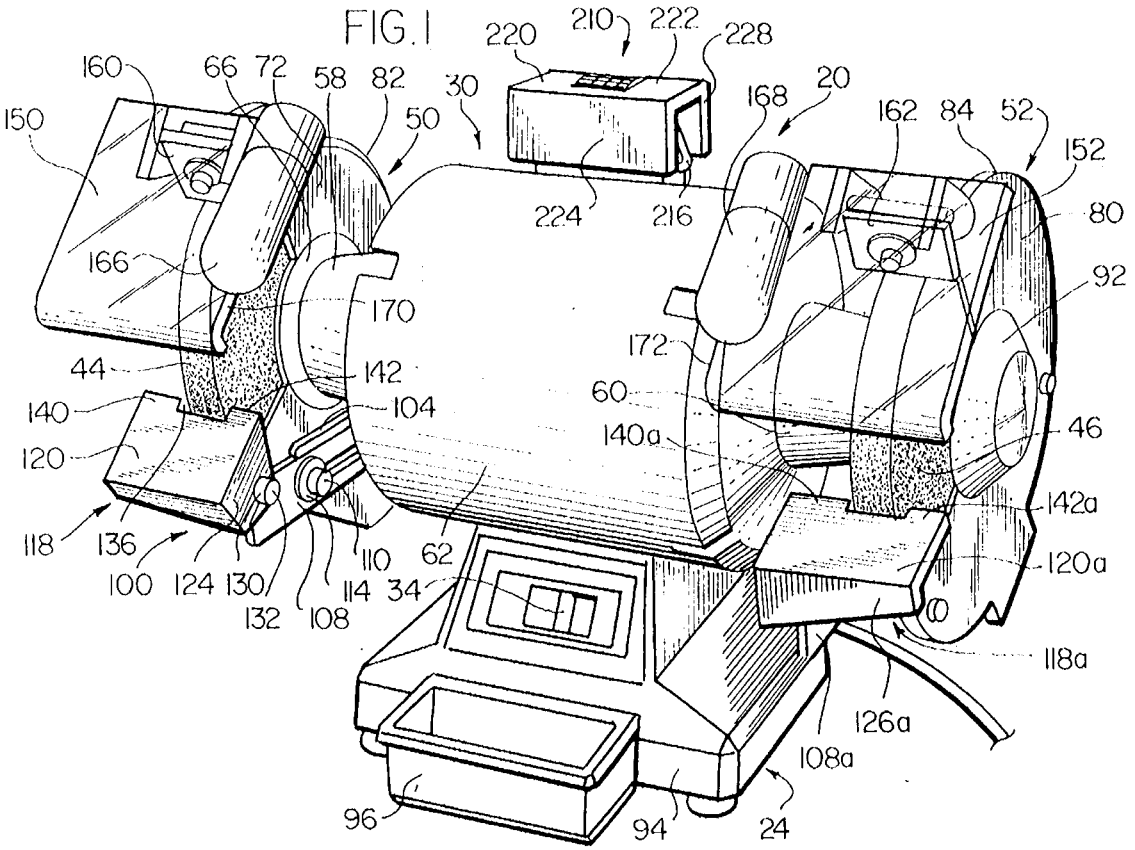
FIG. 1 is a front perspective view of a grinder, in accordance with the invention, showing the features thereof.
Figure 2:
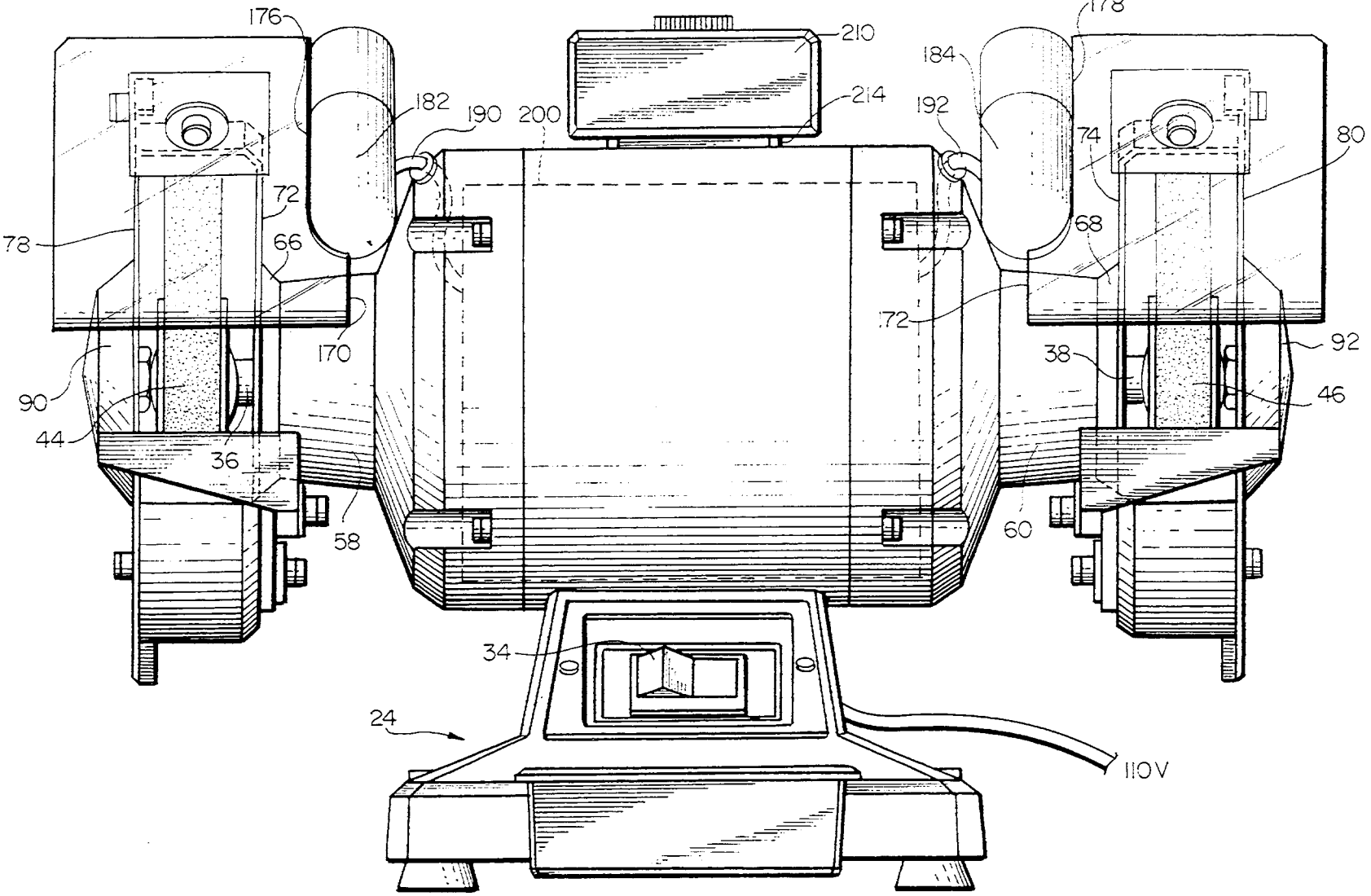
FIG. 2 is an enlarged front elevational view of the grinder of FIG. 1, and indicating schematically the circuit supplying power to the illuminating bulbs.
Figure 3:
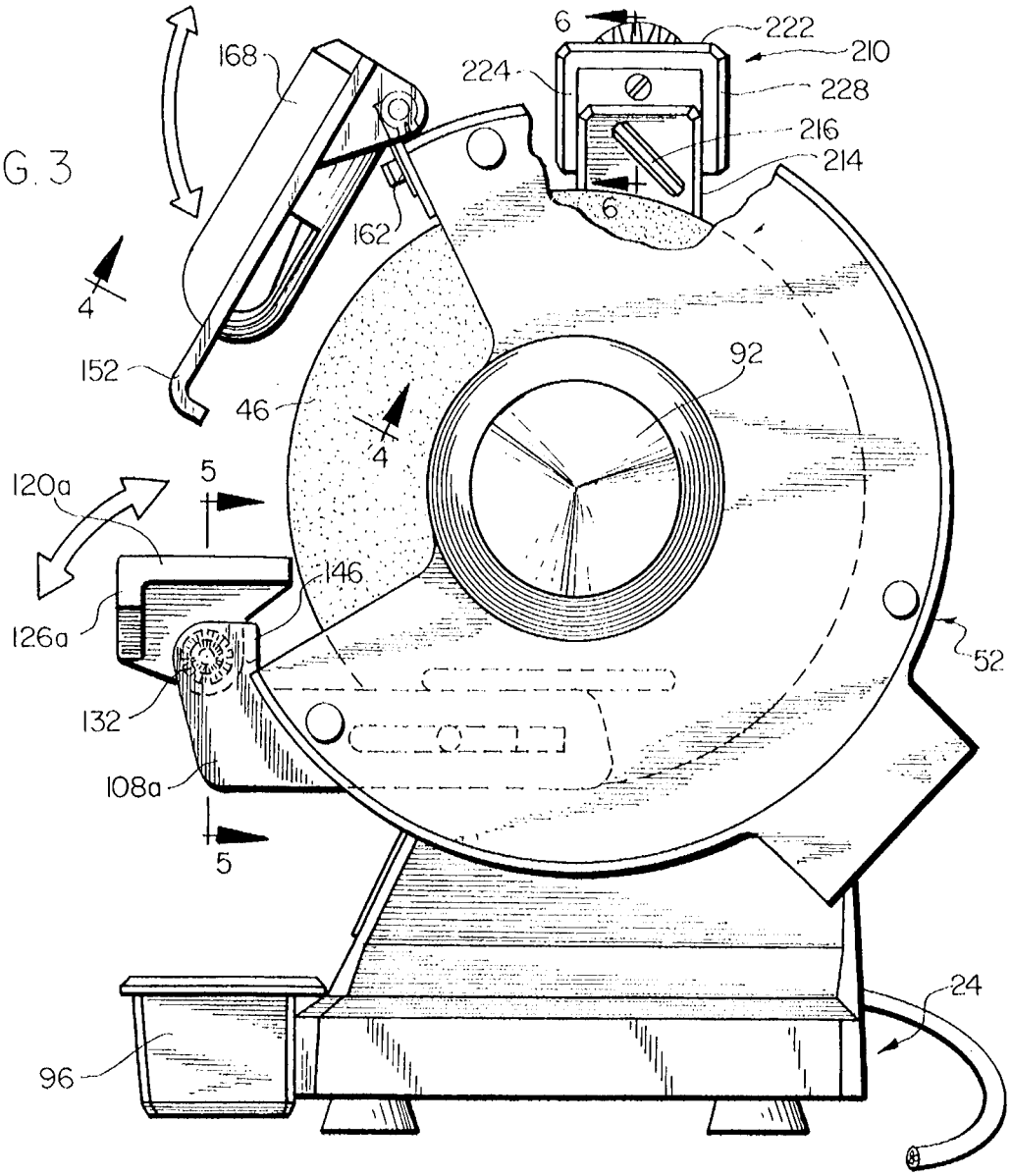
FIG. 3 is an end elevational view of the grinder.
Figure 4:
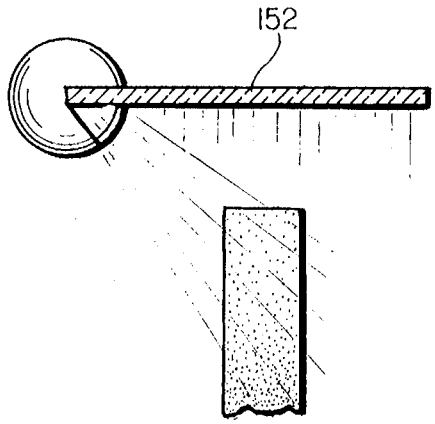
FIG. 4 is a cross-sectional view taken substantially on the lines 4—4 of FIG. 3 and showing a workpiece and shield illuminating lamp in accordance with the invention.
Figure 5:
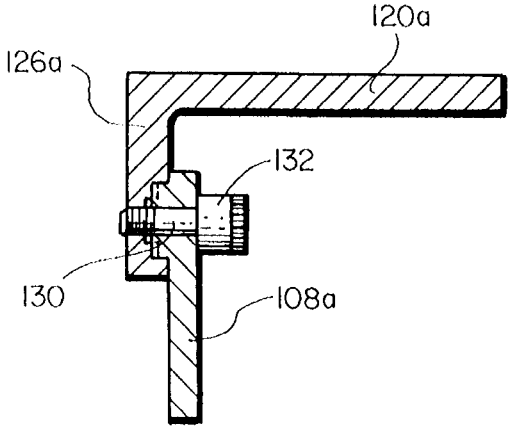
FIG. 5 is a cross-sectional view taken substantially on the lines 5—5 of FIG. 3 and showing an adjustable tool rest in accordance with the invention.

Referring now to the drawings, and more particularly to FIGS. 1, 2 and 3, for purposes of disclosure and not in any limiting sense, a preferred embodiment of the bench grinder 20 of the invention is shown as including a base or a table or other substrate (not shown). Secured to and supported on the base 24 is a 110-volt electric drive motor 30 provided with an electric cord assembly 32 for connecting to a power outlet junction (not shown). An ON-OFF switch 34 for connecting power to the motor assembly 30 is mounted at the front face of the pedestal 24 for ready and convenient access. A pair of coaxial drive shafts 36 and 38 projecting laterally from opposed sides of the motor 30 support a pair of rotatably-mounted motor-driven grinder wheels or tool elements 44 and 46 at either side of the motor 30, Protective housing assemblies 50 and 52 of metal or of plastics compositions are secured to the motor housing 56 at either of opposed sides thereof. The housings 50 and 52 include generally-tubular, drive-shaft-encircling hub sections 58 and 60 attached to and projecting laterally from each of opposed sides of the motor housing 62. The hub sections 58 and 60, which preferably take the forms of frusto-conical sections, terminate at their respective outwardly-directed ends in circular flanges 66 and 68. Secured to each respective flange 66 and 68 is a radially-outwardly-directed circular inner wall 72 and 74. Each respective inner wall 72 and 74 is connected to a cooperating outer wall 78 and 80 (outside of the grinder wheels 44 and 46) by means of an intermediate annular ring, band or wall 82 and 84 which is spaced radially from and encircles the respective grinder wheels 44 and 46. As shown, the inner and outer sidewalls 72 and 74 and 78 and 80 as well as the connecting annular walls 82 and 84 are cut away in arcuate zones thereof presented to the operator of the grinder to allow physical access to a limited sector of the grinder wheels 44 and 46. Centrally positioned end caps 90 and 92 are secured to the outer walls 78 and 80 of the grind wheel housings 50 and 52.

Attached to the front 94 of the base or pedestal 24 of the grinder assembly is a metal trough 96 serving as a convenient reservoir for water or some other coolant, etc.

Important advantages provided in the grinder of the invention stem from improvements in tool rest configuration and manipulation of the pivotally-adjustable protective shields, and in the illumunation system. As shown in FIGS. 1–3, the tool rest assembly 100 includes a rearwardly and forwardly adjustably positionable two component side bracket component 104 one of which is fastened to the inner wall 72 and 74 of the protective housing assemblies 50 and 52, at lower zones thereof. Slidably secured within the remote bracket component is a cooperating bar-like bracket 108 and 108*a* lockable in selectable retracted and extended modes by means of stub shaft 110 carried lock nut 114.

A tool rest 118 and 118*a* having a top wall 120 and 120*a* connected to a depending side wall 124 and a depending front wall 126 and 126*a* is pivotally mounted, adjustably, at its side wall 124 to the bracket cooperating stub shaft 130 and a frictionally engaging nut-like fastener 132. It is a feature of a preferred embodiment of the invention that the top wall or tool rest wall 120 and 120*a* of the rest assembly 100 is formed with a grind wheel receiving slot 136 so that the tool-supporting top wall 120 and 120*a* includes sections 140 and 142 and in 140*a* and 142*a* extending forwardly and in zones laterally of the abrasive grinder wheels 44 and 46 for facilitating the effective use of a wide side surface of the grinder wheels in a grinding operation. The tool rest 118 has a stop 146 so that it cannot be angled below horizontal.

The bench grinder of the invention is fitted with a pair of protective shields 150 and 152 of transparent plastics compositions. The shields 150 and 152 are pivotably and adjustably secured to support bracket assemblies 160 and 162. The latter hold the shields 150 and 152 interposed between the grinder wheels 44 and 46 and the machine operator to protect the operator from flying debris generated during use of the grinder.

Attached to the protective shields 150 and 152 for movement therewith are a pair of illuminating lamps 166 and 168. In the particular preferred embodiment of the invention illustrated the shields 150 and 152 are cut away at inwardly presented bounding idges 170 abd 172 thereof so that the lamps 166 and 168, which are attached to the shields 150 and 152, nest against the set-back side edges 176 and 178, as shown in FIGS. 1 and 2.

In the arrangement described, the lamps serve to illuminate the shields 150 and 152 along their side edges 176 and 178 and the light is delivered throughout the expanse of the shields 150 and 152 themselves. This arrangement, in cooperation with light-shielding reflector caps 182 and 184 of spun aluminum which are secured to overlie the lamps 166 and 168, ensure excellent and maximum controlled illumination while reducing glare to a minimum.

It is an important feature of the invention that the illumination lamps are of a type resistant to vibration and to shock. 12-volt automobile-type bulbs have proven quite satisfactory and an improvement over those previously employed. Energy to light the bulbs is delivered by conductors 190 and 192 which are connected into the windings 200 of the motor as pick-up leads for the required 12-volt supply.

Maintaining the grinding surfaces of the grinder wheels clean and in a true configuration is important in ensuring safe and effective operation of the bench grinder.

A wheel dresser is conventiently used as a tool to keep the grinder wheels round and in good condition. To ensure ready and convenient access and availability, in accordance with the practice of the present invention, a wheel dressing tool 210 provided with as a component of the bench grinder 20 is mounted on a support fixture 214 fastened to the top of the drive motor 30. The same fixture 214 carries an Allen-type wrench 216 for making required settings and adjustments on the components of the bench grinder, as required.

Figure 6:
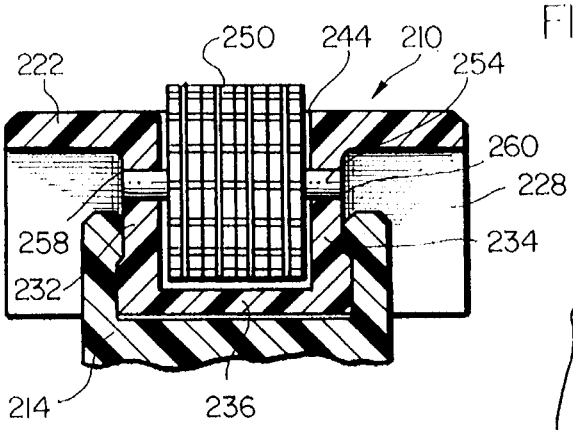
FIG. 6 is a cross-sectional view taken substantially on the lines 6—6 of FIG. 3, and showing the wheel dressing tool releasably secured on the grinder.

The wheel dresser 210 of the invention is uniquely configured so that it can be safely and conveniently hand held in use. As shown in FIGS. 1 and 6 through 8 the dresser 210 includes a body 220 which is generally U-shaped in transverse section and includes a front wall 222 joined to a top wall 224 and a bottom wall 228. Interiorly of the body 220 of the dressing tool 210 and integrally formed with the front wall 220 and with the top and bottom walls 224 and 228 are a pair of laterally-spaced interior walls 232 and 234 bridged at their base with a connecting wall 236. The walls 232 and 234 and 236 define, with the cut out areal zone 240 in the front wall of the body 220 of the dresser assembly 210 a cavity-like chamber 244 or housing for a plurality of concentric discs 250 rotatably supported in the chamber 244 on a shaft 254 journalled in cooperating bores 258 and 260 formed in the supporting walls 232 and 234, as shown in FIG. 6. The wheel-treating discs 250 extend outwardly of and beyond the front wall 222 of the holder body 220 for functional presentation against the surface of the grinder wheels 44 and 46 as indicated schematically in FIGS. 7 and 8.

Figure 7:
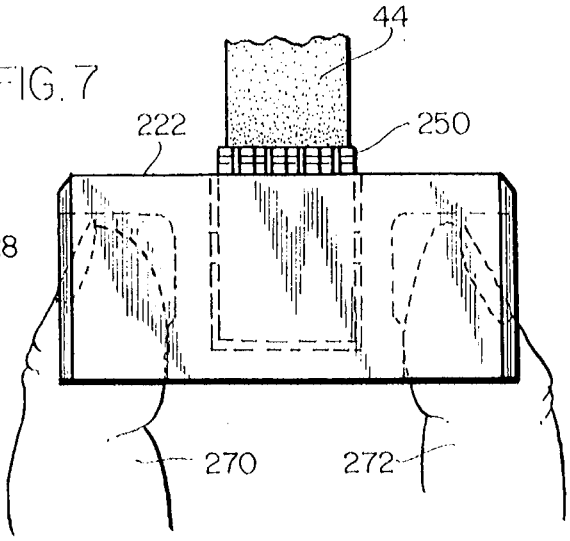
FIG. 7 is a fragmentary, schematic representation of the hand-held dressing tool being applied to the surface of a grinding wheel of the grinder of the invention.
Figure 8:
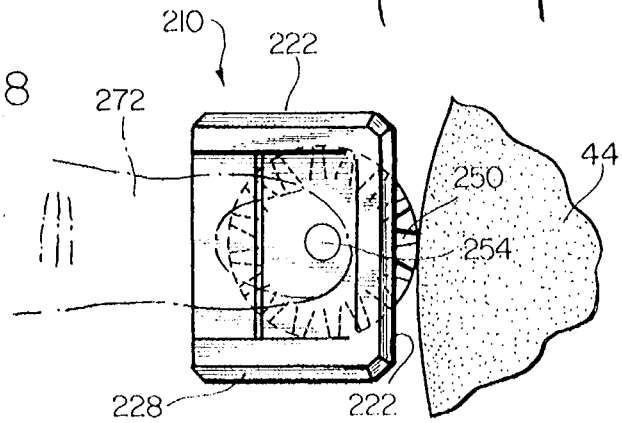
FIG. 8 is a fragmentary side-view representation of the dressing tool of the invention being hand-held and functionally applied to dress the surface of one of the grinder wheels of the grinder of the invention.

As evident from FIGS. 6 and 7, upon withdrawal of the dressing tool 210 from the supporting fixture 214, the tool is conveniently gripped at the opposed side openings 264 and 266 using one's thumb 270 and forefinger 272 and firmly and safely held in a mode for presentation of the trueing elements 250 to the surface of the grinder wheels 44 and 46 as depicted schematically in FIGS. 7 and 8.

What is claimed is:

1. In a bench grinder including base means of said grinder for supporting said grinder on a substrate, an electric motor of said grinder supported on said base means, motor driven shaft means having shaft end portions extending laterally from said motor at either side thereof for rotatably supporting motor-driven tool elements used in grinding operations conducted with said bench grinder, a pair of drivable tool elements mounted on said shaft end portions, one at either side of said motor, a pair of transparent shield means of plastics composition for protecting an operator of said bench grinder, and fastener means for mounting said shield means on said grinder to overlie at least a section of each tool element presented to an operator using said grinder, lighting means for illuminating said grinder during use thereof, tool rest means for aid in supporting and steadying a tool during a grinding operation, and switch means for controlling delivery of electrical power to energize said motor and to illuminate said lighting means during operation of said grinder, the improvement wherein said lighting means comprise a pair of illuminating lamps, and fastener means for attaching each one of said pair of lamps respectively to each shield of said pair of shield means, attachment means for supporting said lighting means on said shield means, laterally thereof for movement therewith, shade means overlying each of said lighting means and interposed between said lighting means and an operator for reflectively directing illumination toward a work zone adjacent said grinder wheels and for reducing objectionable, disruptive glare, and said lighting means being mounted at laterally inwardly extending edges of said shield means, and said shield means being cut away to provide a recess in which said lighting means are nestingly received.

2. The bench grinder as set forth in claim 1 wherein said lighting means are located so as to direct light to impinge on lateral end edges of said shield means to end-light said shield means to spread and to disperse illumination throughout a work zone of said grinder to be viewed.

3. The bench grinder of claim 1 and further comprising axle support means for pivotally supporting said tool rest means, and stop means for preventing the pivoting of said tool rest means forwardly and downwardly beyond a horizontal disposition of said tool rest means.

4. The bench grinder of claim 1 wherein said tool support means includes a tool support section extending forwardly of and in a zone laterally of one said pair of abrasive grinder wheels for facilitating effective use of a side surface of a grinder wheel of said bench grinder in a grinding operation.

5. In a bench grinder including base means of said grinder for supporting said grinder on a substrate, an electric motor of said grinder supported on said base means, motor driven shaft means having shaft end portions extending laterally from said motor at either side thereof for rotatably supporting motor-driven tool elements used in grinding operations conducted with said bench grinder, a pair of drivable tool elements mounted on said shaft end portions, one at either side of said motor, a pair of transparent shield means of plastics composition for protecting an operator of said bench grinder, and fastener means for mounting said shield means on said grinder to overlie at least a section of each tool element presented to an operator using said grinder, lighting means for illuminating said grinder during use thereof, tool rest means for aid in supporting and steadying a tool during a grinding operation, and switch means for controlling delivery of electrical power to energize said motor and to illuminate said lighting means during operation of said grinder, the improvement wherein said lighting means comprise a pair of illuminating lamps, and fastener means for attaching each one of a pair of lamps respectively to each shield of said pair of shield means, lamps of said lighting means being characterized in exhibiting high resistance to damage from vibrational forces impressed thereupon during operation of said grinder, electrical lead lines for said lighting means, and means connecting said lead lines of said electric motor of said grinder at windings thereof to deliver a 12-volt supply for energizing lamps of said lighting means.

6. The bench grinder as set forth in claim 1 wherein said transparent shield means is yellow in color to reduce visual glare from said lighting means, thereby to facilitate operation add to enhance safety.

7. A grinder wheel dresser for functional employment using only one hand, said dresser being operational for refacing a grinder surface of skid grinder wheel, means removably securing said wheel dresser to a grinder pending retrieval and functional use of said wheel dresser, said dresser having a U-shaped body including a vertical front wall having a generally rectangular through opening formed therein in a center zone thereof, a pair of spaced walls including parallely-extending upper and lower walls integral with said front wall and extending rearwardly thereof, a hand-grip core section of said dresser integral with, disposed between, and bridging said upper and lower walls of said wheel dresser for manual gripping of said wheel dresser for functionally employing said dresser while held in one hand, said core section being formed at a forward mid-zone thereof with a chamber-like cavity opening forwardly and communicating with said through opening in said front wall of said wheel dresser, wheel-dressing disc means supported and secured in said dresser in said core section thereof, shaft means secured in said core section of said dresser for rotatably supporting said disc means within said cavity to present operational end faces of said disc means forwardly and rotatably through said opening formed in said front wall of said body of said wheel dresser, for stressingly engaging a driven revolving surface of said grinder wheel upon free-hand presentation of said disc means thereto through employment of one hand only.

8. The bench grinder as set forth in claim 1 and further comprising receptacle means for retaining wrench means for use on said bench grinder for maintenance and disassembly of said bench grinder add for effecting adjustments thereof, and means for mounting said receptacle means on said bench grinder.

9. The bench grinder as set forth in claim 1 add further comprising means for adjustably supporting and selectively securing said tool rest means pivotally and at forwardly and rearwardly displaced positions with respect to said motor driven tool elements.

10. The bench grinder as set forth in claim 1 and further comprising a grinder wheel dresser and means for mounting said dresser on said bench grinder, wherein said wheel dresser comprises a generally U-shaped body including a vertical front wall having a generally rectangular through opening formed therein in a center zone thereof, a pair of spaced walls including parallely-extending upper and lower walls integral with said front wall and extending rearwardly thereof, a hand-grip core section of said dresser integral with, disposed between, and bridging said upper and lower walls of said wheel dresser, said core section being formed at a forward mid zone thereof with a chamber-like cavity opening forwardly and communicating with said through opening in said front wall of said wheel dresser, wheel-dressing disc means for dressing a grinder wheel, and secured in said core section of said dresser, shaft means secured in said core section of said dresser for rotatably supporting said disc means within said cavity to present operational end faces of said disc means forwardly and rotatably through said opening formed in said front wall of said body of said wheel dresser, for stressingly engaging a driven revolving surface of a grinding wheel to be dressed, and for dressing said grinding wheel.

11. In a bench grinder including base means of said grinder for supporting said grinder on a substrate, an electric motor of said grinder supported on said base means, motor-driven shaft means having shaft end portions extending laterally from said motor at either side thereof for rotatably supporting motor-driven tool elements used in grinding operations conducted with said bench grinder, transparent shield means for protecting an operator of said bench grinder, and fastener means for mounting said shield means on said grinder to overlie at least a section of each tool element presented to an operator using said grinder, and lighting means for illuminating said grinder during use thereof, and electrical lead lines for said lighting means, the improvement comprising means connecting said lead lines to said electric motor of said grinder at windings thereof to deliver a 12-volt supply for energizing said lighting means, said lighting means being characterized in exhibiting high resistance to damage from vibrational forces imposed during operation of said grinder.

* * * * *